United States Patent [19]

Smith, Jr.

[11] 4,151,991

[45] May 1, 1979

[54] BILLIARD CUE CHALK HOLDER

[76] Inventor: Johnny M. Smith, Jr., 2957 Bridgeport, Anaheim, Calif. 92805

[21] Appl. No.: 861,932

[22] Filed: Dec. 19, 1977

[51] Int. Cl.[2] ..... A63D 15/16

[52] U.S. Cl. ..... 273/21; 70/168

[58] Field of Search ..... 273/17, 18, 19, 20, 273/21; 312/249; 222/153; 221/154; 206/1.5; 211/4, 8, 68; 70/63, 163, 77, 164, 57, 168; 339/36, 37

[56] References Cited

U.S. PATENT DOCUMENTS

| | | | |
|---|---|---|---|
| 93,356 | 8/1869 | Shaw | 273/19 |
| 605,683 | 6/1898 | Sieverling | 273/21 |
| 814,872 | 3/1906 | Primus et al. | 273/20 |
| 1,334,723 | 3/1920 | Tyler | 273/20 |
| 1,968,506 | 7/1934 | Schmeider | 70/168 |
| 3,096,409 | 7/1963 | Hubbell et al. | 70/63 |
| 3,248,915 | 5/1966 | Scheiman | 70/168 |

*Primary Examiner*—Richard C. Pinkham
*Assistant Examiner*—T. Brown
*Attorney, Agent, or Firm*—Knobbe, Martens, Olson, Hubbard & Bear

[57] ABSTRACT

A billiard cue chalk cube holder, having a base plate mountable on a flat surface by screws, nails, or the like, is provided with a lockable cover which is internally partitioned to form one or more chalk cube receptacles. The cover has an internal latch which is rotatable by a key to alternately engage and disengage slots in the legs of a U-shaped member attached to the base plate. When the cover is attached to the base plate, the nails or screws securing the base plate to the supporting surface are completely concealed, thereby discouraging theft of the chalk cubes.

1 Claim, 5 Drawing Figures

BILLIARD CUE CHALK HOLDER

BACKGROUND OF THE INVENTION

This invention relates to the field of containers for billiard cue chalk cubes. Specifically, this invention pertains to chalk containers which have a lockable cover and which provide for access to the chalk cube by the cue tip through an aperture in the cover.

In the games of billiards and pool, the players apply chalk to the tip of the cue stick to ensure the proper frictional contact between the tip of the cue stick and the cue ball. It has been the long-established practice to fabricate this chalk in the form of small cubes which are wrapped in paper or cardboard on all sides but one. These cubes are quite commonly on the order of three-quarters of an inch to a side, and the small size enables them to be lost or misplaced quite easily. As a result, play is often interrupted while the participants search for the chalk. Further, the chalk cubes often find themselves accidentally dropped into the pcokets of a pool table, thereby obstructing the paths of the pool balls to the ball collection box, which is frequently a part of such tables. In addition, the chalk cubes often fall to the floor and break. Furthermore, in a commercial pool or billiard establishment, theft of the chalk cubes may be of concern.

As a result, various means have been devised to secure one or more of these chalk cubes in a fixed, readily accessible place. One such device is disclosed in Patent No. 605,683 to Sieverling. Sieverling shows a wall-mounted holder for several chalk cubes having a hinged cover. However, with the Sieverling device, one may easily remove the chalk cubes by merely lifting the cover and, through negligence or design, one may fail to return the chalk cubes to the holder, thereby defeating the purpose of the device.

SUMMARY OF THE INVENTION

The present invention overcomes all of the aforementioned problems by providing a chalk cube holder which has a lockable cover. The holder consists of a base plate which is secured to a flat surface, such as a wall, post, or table, by any conventional means such as screws or nails or the like. A cover is provided which preferably takes the form of an oblong box having an opened back. The cover is internally partitioned to form one or more receptacles for chalk cubes which are conveniently inserted through the open back. Each of the receptacles is suitably apertured at the front to permit a cue tip to engage the chalk cube for the application of chalk thereon. The cover is provided with an internal latch consisting of a tongue, which is rotated by a key to alternately engage and disengage slots in the legs of a U-shaped member which is attached to the base plate. When the cover containing the chalk cubes is affixed to the base plate and locked thereto, the cover will completely seal the screws or nails which secure the base plate to the supporting surface.

With this construction, the chalk cube holder will accomplish the desired goal of securing one or more chalk cubes in a fixed location where they may be readily accessible and easily used at all times. The lockable cover ensures that the cubes will not be removed with the consequent possibility of loss or breakage until they are completely used up, thereby affecting greater economy in the use of such cubes. Furthermore, the locking feature will serve to discourage theft, and this end is further served by the fact that the mounting screws or nails are completely concealed by the cover when it is in place.

DETAILED DESCRIPTION OF THE INVENTION

Figure 3:
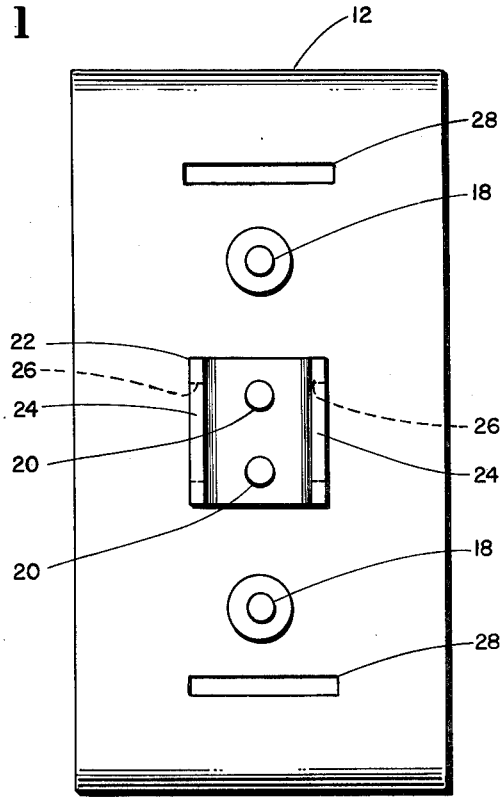
FIG. 3 is a front elevation view of the base plate of the present invention.
Figure 4:
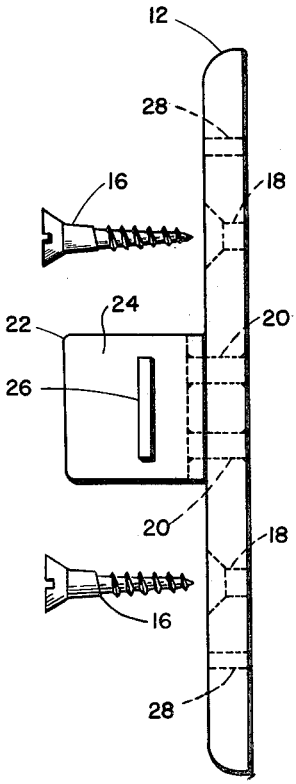
FIG. 4 is a side elevation view of the base plate.

Referring to the drawings, a chalk box holder 10 in accordance with the present invention is comprised of a base plate 12 and a cover 14. The base plate 12 is mounted to a suitable surface, such as a wall, a post, or a table, by means such as screws 16 or any other suitable mounting means, such as, for example, nails. The base plate 12 is provided with a pair of countersunk holes 18 to accommodate the screws 16 and these holes are located so as to be completely concealed when the cover 14 is in place. For example, as shown in FIGS. 3 and 4, the holes 18 are located along the vertical axis of the base plate 12 and offset from the center of the base plate. Centrally located on the base plate 12, and attached thereto by flush rivits 20, is a lock catch 22, comprised of a U-shaped member having forwardly extending legs 24. Each leg is provided with an elongate slot 26 running parallel to the face of the base plate 12. The base plate 12 is further provided with a pair of horizontal slots 28, located so as to encompass between them the apertures 18 and the U-shaped member 22, as shown in FIGS. 3 and 4.

Figure 1:
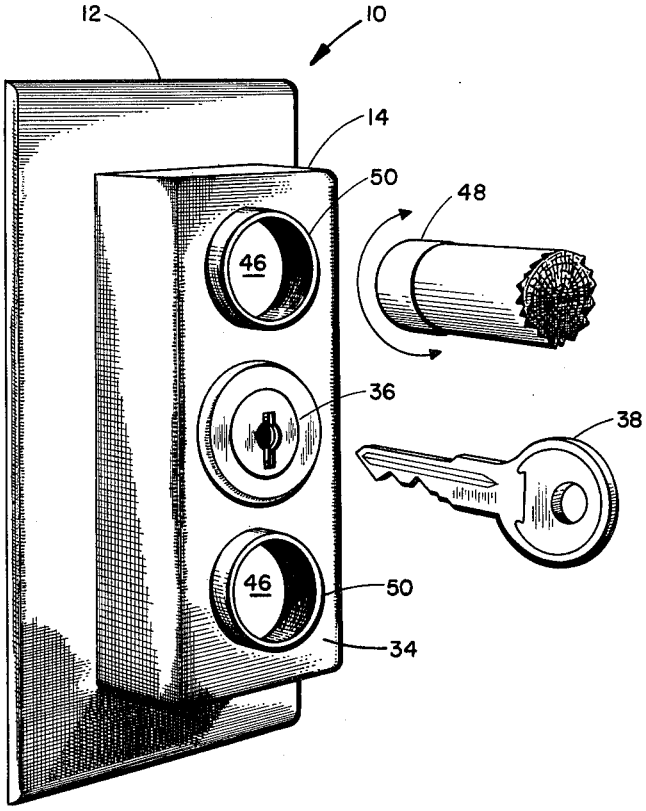
FIG. 1 is a perspective view of the present invention.
Figure 2:
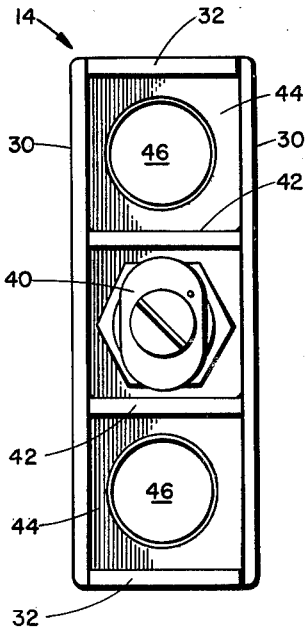
FIG. 2 is a rear elevation view of the chalk cube cover of the present invention.

Referring to FIGS. 1 and 2, the cover 14 is shown as an oblong box which is open at the back where it seats against the base plate 12 along its vertical edges 30. A pair of rearwardly extending horizontal tabs 32 are provided at the upper and lower extremities of the cover 14. The tabs 32 engage the slots 28 in the base plate 12 when the cover 14 is fastened to the base plate 12. The front panel 34 of the cover 14 is fitted with a lock 36 which is actuated by a key 38. When the key 38 is inserted into the lock 36 and rotated, it will rotate a lock latch in the form of a flattened elliptical tongue 40 which is pivotally mounted on the inside of the front plate 34. A pair of horizontal members 42 traverse the interior of the cover 14 above and below the rotating tongue 40. The members 42 serve to divide the interior of the cover into upper and lower chalk receptacles 44. Each receptacle is provided with a circular aperture 46 to permit the insertion of a cue tip 48, as shown in FIG. 1. Each of the apertures 46 is provided with an outwardly extending neck 50 which acts as a guide for the cue tip.

Figure 5:
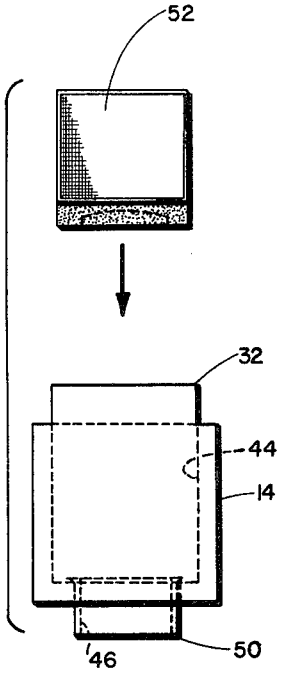
FIG. 5 is a top plan view of the chalk cube cover of the present invention showing the insertion of a chalk cube.

The operation of the chalk cube holder may be described as follows:

After the base plate 12 is suitably mounted to a wall or like surface, the cover 14 is supplied with one or more chalk cubes 52 which are inserted into the rearwardly open receptacles 44, as illustrated in FIG. 5. The tongue 40 may be manually rotated from the inside of the cover 14 so that it is aligned parallel with the legs 24 of the U-shaped lock catch 22. The cover is then placed on the base plate 12 with the tabs 32 fitting into the slots 28. The key 38 is then inserted into the lock 36 and turned to rotate the tongue 40 ninety degrees so that the tongue catches in the slots 26 in the legs 24. The cover is now locked to the base plate and the key may be removed. When it is desired to chalk the cue tip 48, it is inserted into one of the orifices 46 where it contacts the face of the chalk cube 52 and the cue is then rotated to apply the chalk to the tip, as illustrated in FIG. 1.

Although the embodiment shown accommodates two chalk cubes, it is understood that the invention may be modified to accommodate as many cubes as is desired without departing from the scope of the invention. It is also to be understood that although the locking mechanism hereinabove disclosed, consisting of the rotating member 40 and the U-shaped member 22, is preferred due to its simplicity of construction and operation, other locking mechanisms may be used without departing from the scope of the invention.

What is claimed is:

1. An apparatus for holding a billiard cue chalk cube, comprising:

a base plate having a slot near one end thereof;

mounting means in said base plate for securing said base plate to a flat surface;

a lock catch fixed to said base plate, said lock catch comprising a U-shaped member with forwardly extending legs, at least one of said legs having a slot parallel to said base plate;

a chalk cube cover removably attached to said base plate, said cover having a rearward opening to permit the insertion of a chalk cube, a frontal aperture to permit a billiard cue tip to engage said chalk cube, and a rearwardly extending tab which engages said slot in said base plate, said cover completely concealing said mounting means and said lock catch;

key-actuated means in said cover for releasably engaging said slot in said legs of said lock catch, said key-actuated means comprising a rotatable flat, elliptical member which fits between said legs of said U-shaped member when disposed parallel thereto, and which engages said slot in said leg when rotated by said key to be disposed transversely to said legs.

* * * * *